US005678904A

United States Patent [19]

Hung

[11] Patent Number: 5,678,904

[45] Date of Patent: Oct. 21, 1997

[54] DETACHABLE WARDROBE

[76] Inventor: Tzu-Wen Hung, 58, Ma Yuan West St., Taichung, Taiwan

[21] Appl. No.: 729,907

[22] Filed: Oct. 15, 1996

[51] Int. Cl.[6] ..... E04H 1/12

[52] U.S. Cl. ..... 312/3; 312/6; 312/265.1; 211/182; 135/121

[58] Field of Search ..... 312/3, 6, 257.1, 312/265.1, 265.4; 211/189, 182; 135/909, 900, 901, 128, 114, 115, 121

[56] References Cited

U.S. PATENT DOCUMENTS

| | | | |
|---|---|---|---|
| 832,625 | 10/1906 | Ryan | 312/6 |
| 968,352 | 8/1910 | Hermann | 312/3 |
| 1,828,535 | 10/1931 | Kass | 312/3 |
| 2,305,279 | 12/1942 | Smith | 312/3 |
| 2,440,192 | 4/1948 | Cowan | 312/6 |
| 2,517,757 | 8/1950 | Adlerstein | 312/3 |
| 3,104,626 | 9/1963 | Brunette | 211/182 X |
| 3,272,582 | 9/1966 | Anderson et al. | 312/265.4 |
| 3,424,178 | 1/1969 | Yazaki | 135/909 X |
| 4,304,224 | 12/1981 | Fortney | 312/3 X |
| 5,012,938 | 5/1991 | King | 211/182 X |
| 5,622,415 | 4/1997 | Felsenthal et al. | 312/3 X |

*Primary Examiner*—Peter M. Cuomo
*Assistant Examiner*—James O. Hansen

[57] ABSTRACT

A detachable wardrobe comprises a frame device and a casing enclosing the frame device. The frame device comprises a top frame having four three-way corner joints, a middle frame having four four-way joints, a bottom frame having four three-way bottom joints, a first bearing plate disposed on the bottom frame, a second bearing plate disposed on the middle frame, and a plurality of longitudinal rods disposed between the top frame and the middle frame and disposed between the middle frame and the bottom frame.

4 Claims, 4 Drawing Sheets

DETACHABLE WARDROBE

BACKGROUND OF THE INVENTION

The present invention relates to a wardrobe, and more particularly, the present invention relates to a detachable wardrobe.

Most conventional wardrobes cannot be detached at all. The wardrobe has a single chamber only. It is difficult to provide a detachable wardrobe with three chambers.

SUMMARY OF THE INVENTION

An object of the present invention is to provide a detachable wardrobe which can be easily detachable or assembled.

Accordingly, a detachable wardrobe comprises a top frame having four three-way corner joints, a middle frame having four four-way joints, a bottom frame having four three-way bottom joints, a first bearing plate disposed on the bottom frame, a second bearing plate disposed on the middle frame, and a plurality of longitudinal rods disposed between the top frame and the middle frame and disposed between the middle frame and the bottom frame. The top frame has a plurality of hanger rods. The middle frame has a plurality of crossbars. The bottom frame has a plurality of transverse bars. The casing encloses the frame device. The casing has an upper housing enclosing the top frame, a lower housing enclosing the middle frame, and a middle housing disposed under the upper housing. An upper chamber is formed between the upper housing and the middle housing. A middle chamber is formed between the middle housing and the lower housing. A lower chamber is formed between the lower housing and the first bearing plate.

DETAILED DESCRIPTION OF THE INVENTION

Figure 1:
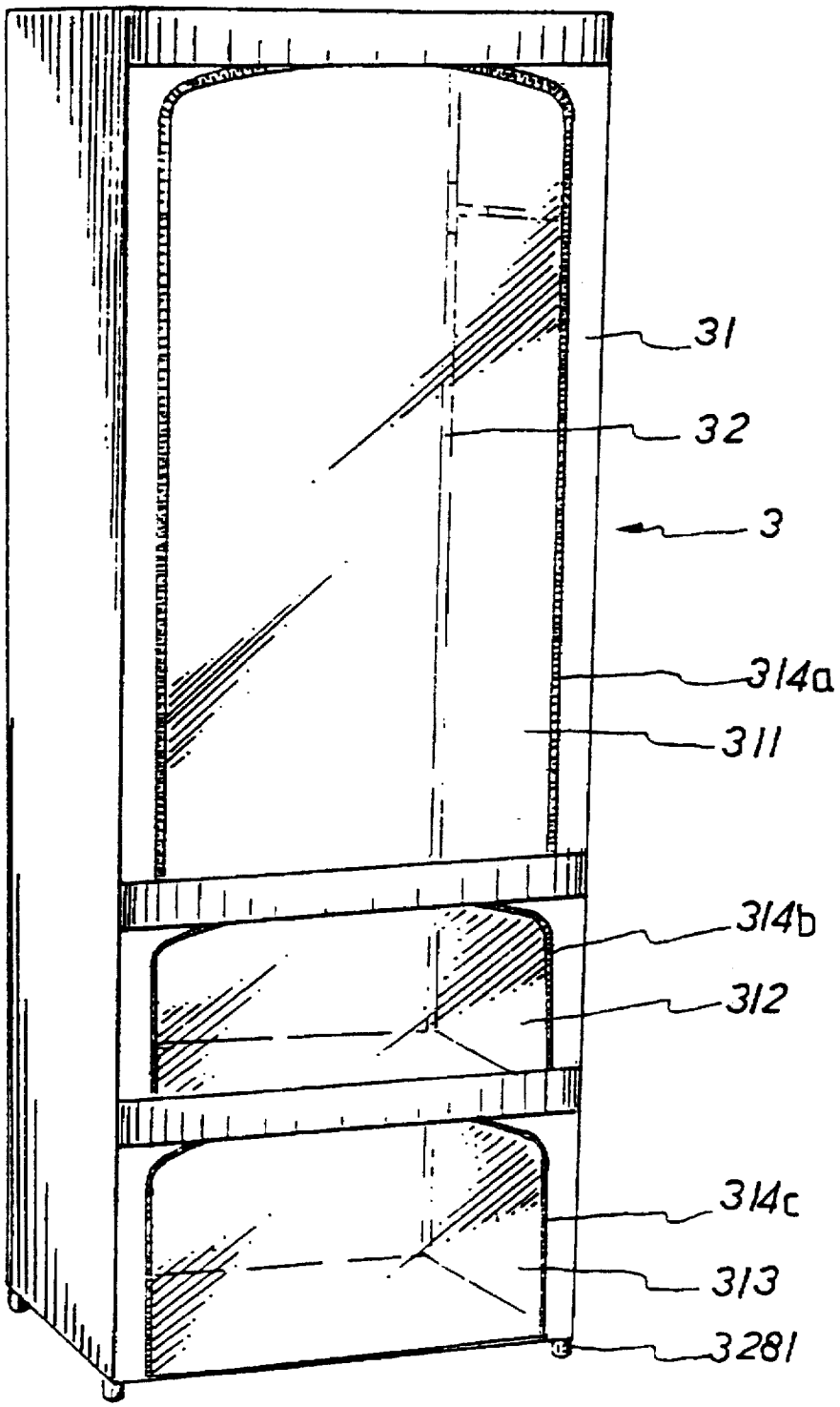
FIG. 1 is a perspective assembly view of a detachable wardrobe of a preferred embodiment in accordance with the present invenion.
Figure 2:
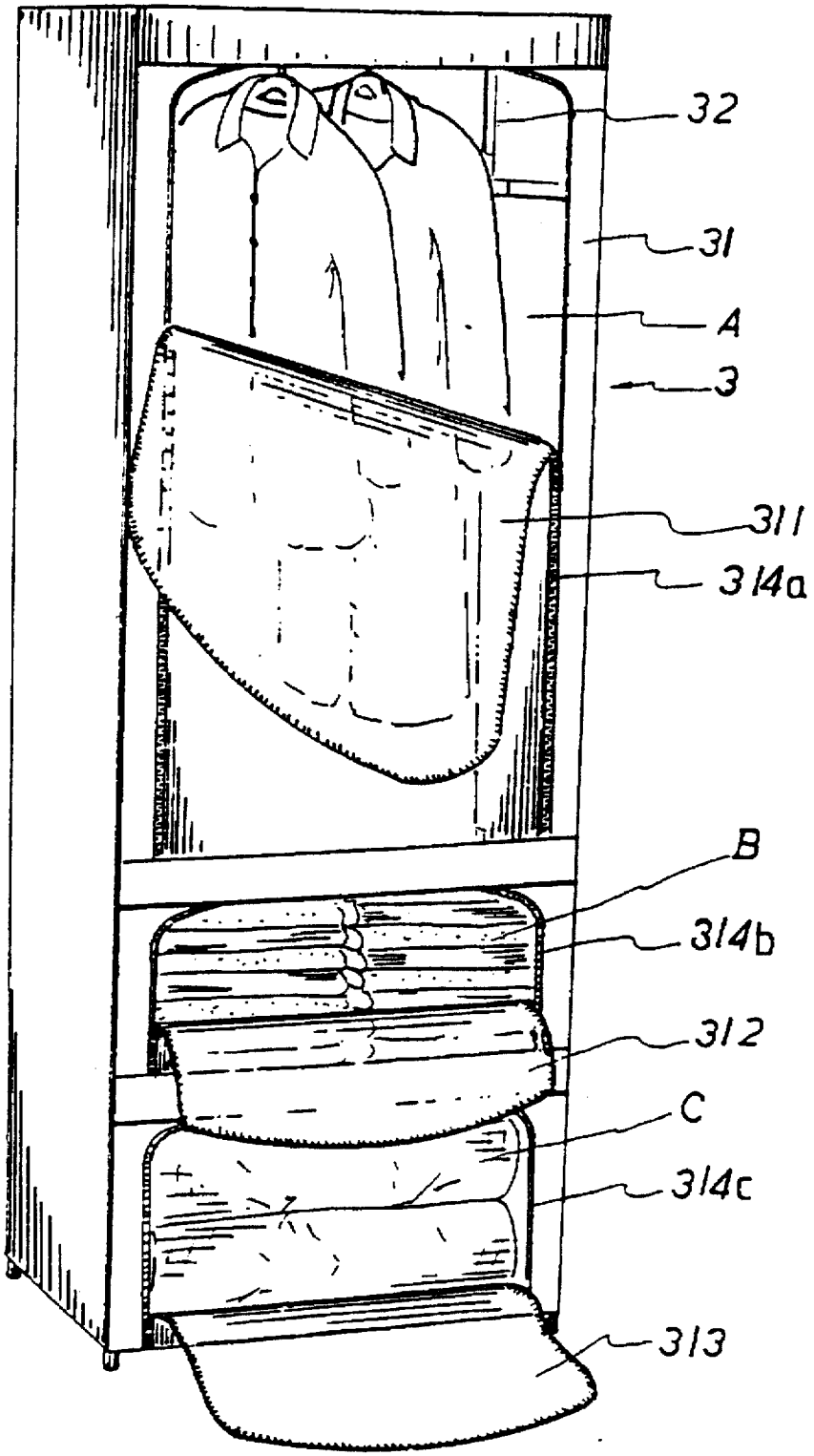
FIG. 2 is a perspective schematic view illustrating an application of a detachable wardrobe.
Figure 3:
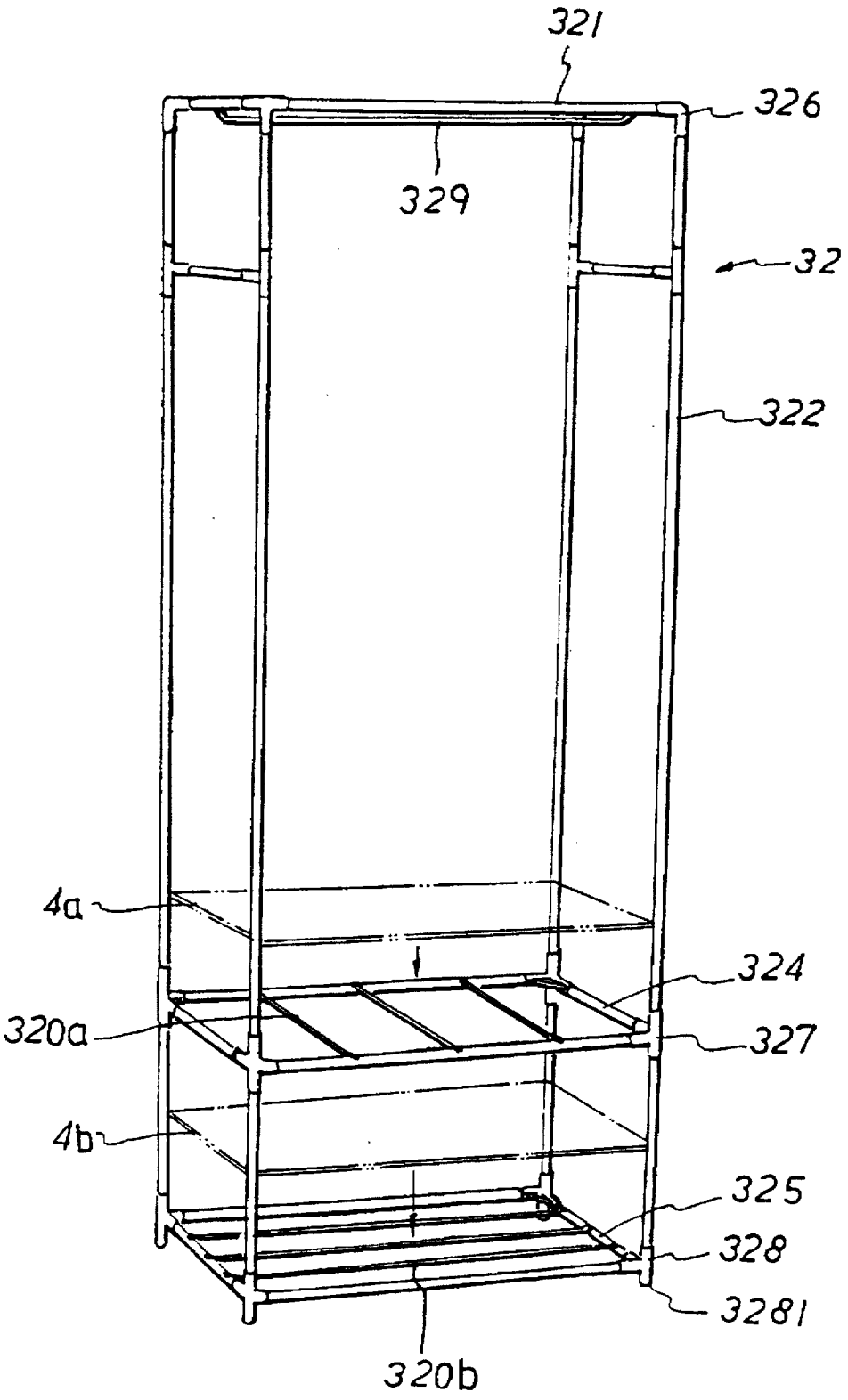
FIG. 3 is a perspective assembly view of a frame device of a detachable wardrobe of a preferred embodiment in accordance with the present invention.
Figure 4:
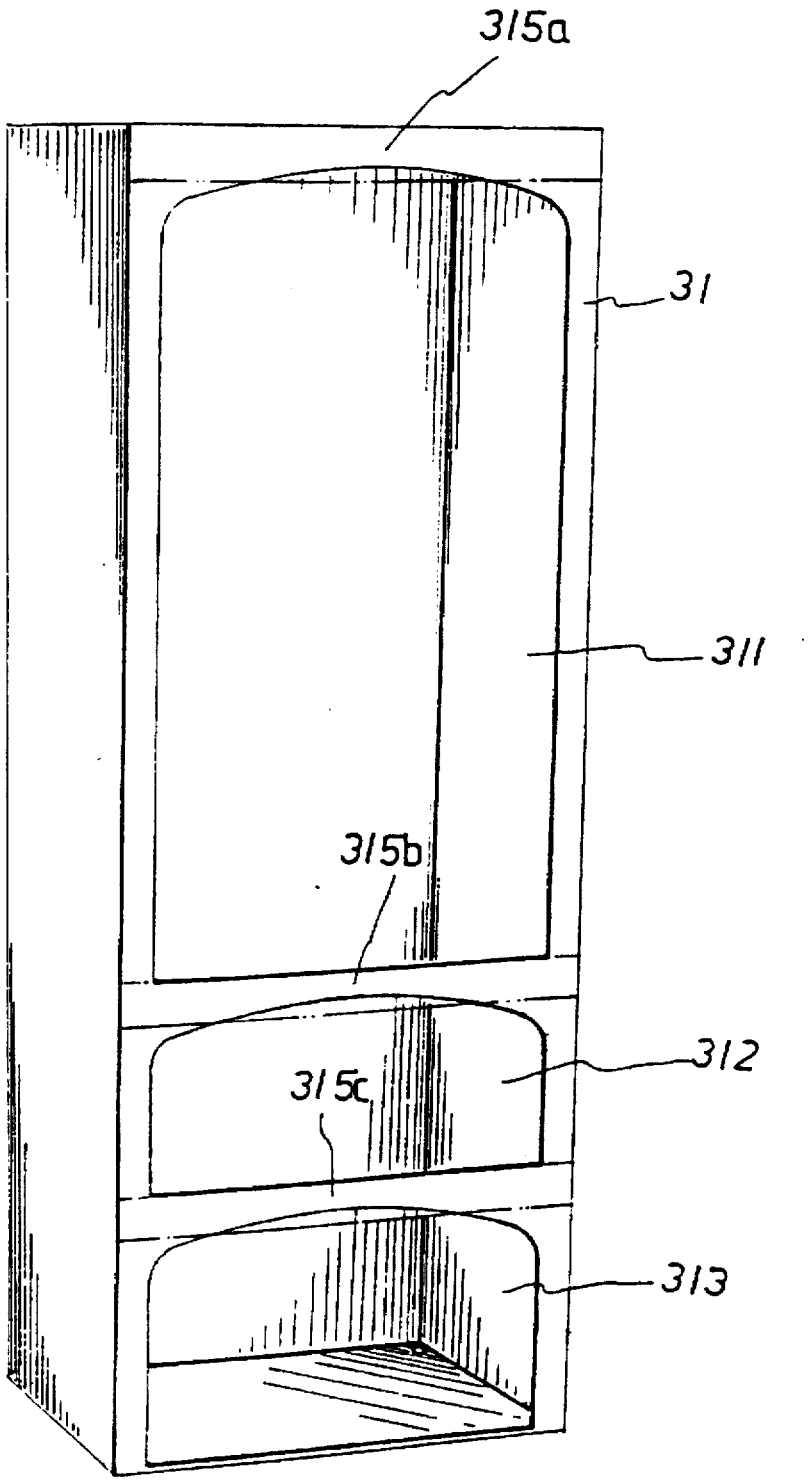
FIG. 4 is a perspective assembly view of a casing of a detachable wardrobe of a preferred embodiment in accordance with the present invention.

Referring to FIGS. 1 to 4, a detachable wardrobe comprises a frame device 32 and a casing 31. The frame device 32 comprises a top frame 321 having four three-way corner joints 325, a middle frame 324 having four four-way joints 327, a bottom frame 325 having four three-way bottom joints 328, a first bearing plate 4*b* disposed on the bottom frame 325, a second bearings plate 4*a* disposed on the middle frame 324, and a plurality of longitudinal rods 322 disposed between the top frame 321 and the middle frame 324 and disposed between the middle frame 324 and the bottom frame 325.

The top frame 321 has a plurality of hanger rods 329. The middle frame 324 has a plurality of crossbars 320*a*. The bottom frame 325 has a plurality of transverse bars 320*b*. Each bottom joint 328 is connected to a foot 3281.

The casing 31 encloses the frame device 32. The casing 31 has an upper housing 315*a* enclosing the top frame 321, a lower housing 315*a* enclosing the middle frame 324, and a middle housing 315*a* disposed under the upper housing 315*a*. An upper chamber A is formed between the upper housing 315*a* and the middle housing 315*b*. A middle chamber B is formed between the middle housing 315*b* and the lower housing 315*c*. A lower chamber C is formed between the lower housing 315*c* and the first bearing plate 4*b*.

A first fabric 311 covers the upper chamber A. A second fabric 312 covers the middle chamber B. A third fabric 313 covers the lower chamber C. A first zipper 314*a* fastens the first fabric 311 on the casing 31. A second zipper 314*b* fastens the second fabric 312 on the casing 31. A-third zipper 314*c* fastens the third fabric 313 on the casing 31.

The present invention is not limited to the above-mentioned embodiment but various modification thereof may be made. Furthermore, various changes in form and detail may be made without departing from the scope of the present invention.

I claim:

1. A detachable wardrobe comprises:

a frame device, a casing enclosing the frame device, the frame device comprising a top frame having four three-way corner joints, a middle frame having four four-way joints, a bottom frame having four three-way bottom joints, a first bearing plate disposed on the bottom frame, a second bearing plate disposed on the middle frame, and a plurality of longitudinal rods disposed between the top frame and the middle frame and disposed between the middle frame and the bottom frame, the top frame having a plurality of hanger rods, the middle frame having a plurality of crossbars, the bottom frame having a plurality of transverse bars, the casing having an upper housing enclosing the top frame, a lower housing enclosing the middle frame, and a middle housing disposed under the upper housing, an upper chamber formed between the upper housing and the middle housing, a middle chamber formed between the middle housing and the lower housing, and a lower chamber formed between the lower housing and the first bearing plate.

2. A detachable wardrobe as claimed in claim 1, wherein a first fabric covers the upper chamber.

3. A detachable wardrobe as claimed in claim 1, wherein a second fabric covers the middle chamber.

4. A detachable wardrobe as claimed in claim 1, wherein a third fabric covers the lower chamber.

* * * * *